United States Patent [19]

Garriss

[11] 4,215,627

[45] Aug. 5, 1980

[54] ENERGY CONSERVING LABORATORY HOOD SYSTEM

[76] Inventor: John E. Garriss, 1325 E. Northern Parkway, Baltimore, Md. 21239

[21] Appl. No.: 16

[22] Filed: Dec. 29, 1978

Related U.S. Application Data

[63] Continuation-in-part of Ser. No. 909,532, May 25, 1978, Pat. No. 4,155,289.

[51] Int. Cl.[3] ..... F23J 11/00

[52] U.S. Cl. ..... 98/115 LH; 118/326; 118/DIG. 7; 137/614.11

[58] Field of Search ..... 98/115 LH; 137/614.11; 118/326, DIG. 7

[56] References Cited

U.S. PATENT DOCUMENTS

| | | | |
|---|---|---|---|
| 487,521 | 12/1892 | Glendinning | 126/287 |
| 2,715,359 | 8/1955 | Mackintosh et al. | 98/115 LH |
| 4,023,473 | 5/1977 | Russell | 98/115 LH |

*Primary Examiner*—Ronald C. Capossela
*Attorney, Agent, or Firm*—John F. McClellan, Sr.

[57] ABSTRACT

An energy saving ambient pressure compensating laboratory fume hood system which provides safe, economical constant-velocity hood intake at all positions of hood access-opening and regardless of ambient pressure changes by means, in typical embodiment, of coacting cam and venturi structure linked to the hood sash.

3 Claims, 4 Drawing Figures

OLD ART

OLD ART

Figure 2:
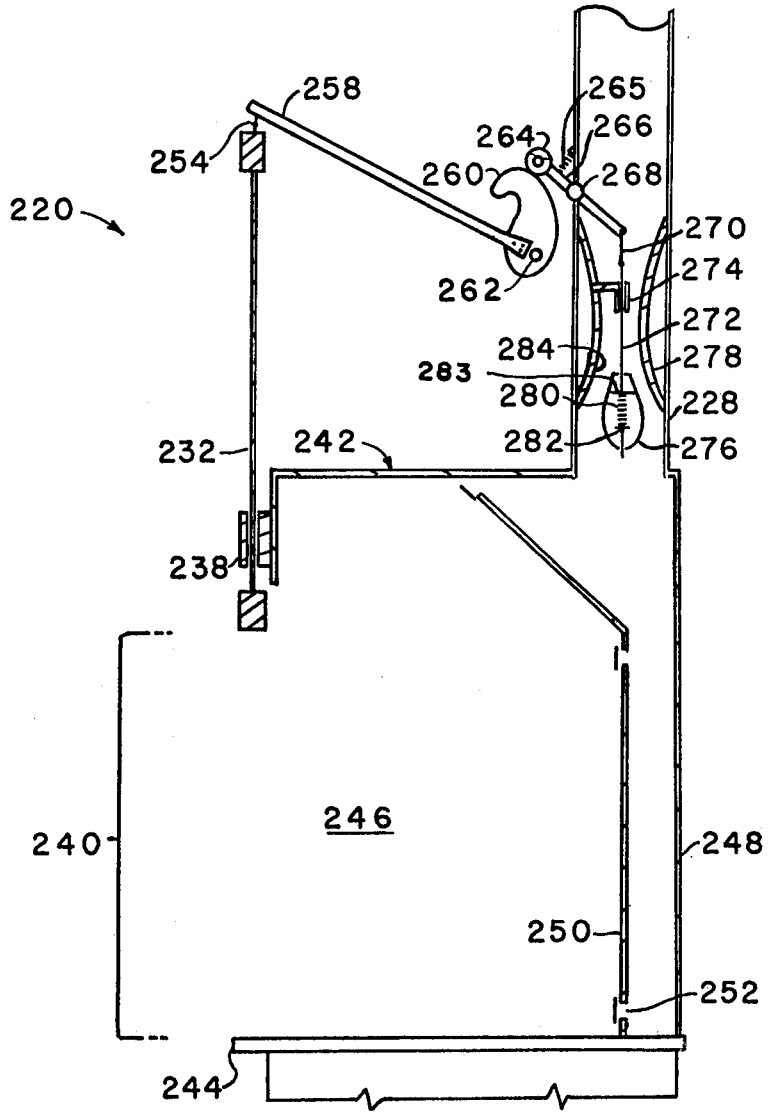

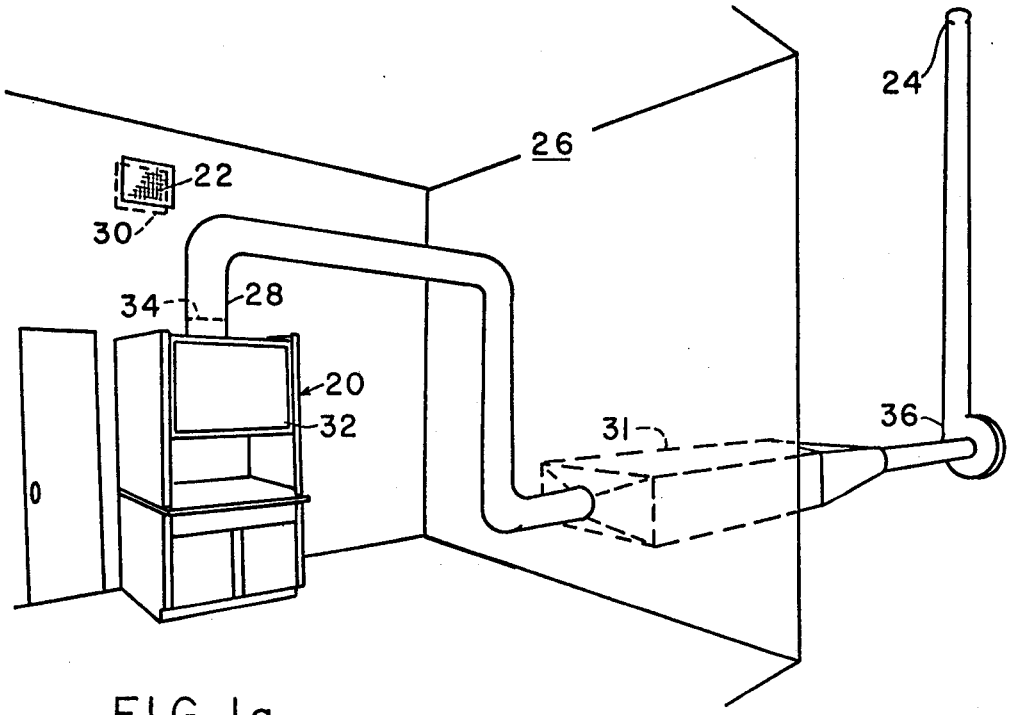
FIG. 1a
FIG. 1b
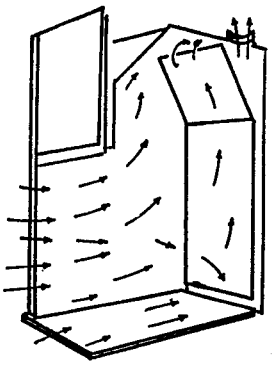
OLD ART
FIG. 1c
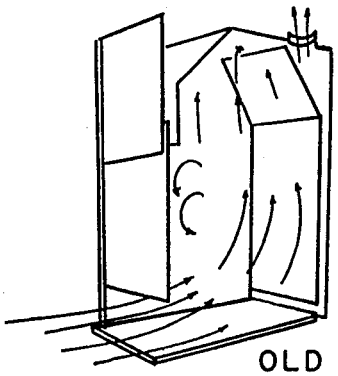
OLD ART

ENERGY CONSERVING LABORATORY HOOD SYSTEM

This application is a continuation-in-part of my copending application, Ser. No. 909,532, filed May 25, 1978 for ENERGY CONSERVING LABORATORY HOOD now U.S. Pat. No. 4,155,289.

This invention relates generally to air handling systems and particularly to laboratory-type fume hoods.

Principal objects of the invention are to provide a hood system which saves more energy and provides more uniform intake velocity under all conditions of operation than previously known fume hoods.

Fume hood systems waste fuel when they exhaust, up-the-chimney, heated or cooled room-ambient air used as purging throughput for the hood. Venting the hood input to outside air sufficient to save depletion of room air is not usually practical because pressure-drop from room into hood must be maintained to protect occupants against fumes and the like. For this pressure drop high velocity airflow is not needed and is not wanted, but is customarily encountered, particularly when the hood sash is partially closed, because minimum velocity is set at the fully open condition.

In the prior art a fume hood intended to provide uniform flow has been disclosed in U.S. Pat. No. 2,715,369 issued to A. D. Mackintosh and T. W. Hungerford on Aug. 16, 1955. However, that fume hood was invented prior to the Fuel Crisis which threatens catastrophic reduction in our standard of living unless we drastically reduce energy consumption. As result, that patent teaches a bypass system in which full flow is always exhausted, the flow through the hood working-space tapping the total flow in proportion to access area opened at the hood access.

In contrast, the present invention has as an object the elimination of all bypass concepts, employing and regulating instead, for maximum energy efficiency, only working throughput of the hood.

More specifically, objects of this invention are to provide a system as described which:

Makes each single unit laboratory hood a calibrated flow device, which automatically controls its own volume flow rate and automatically changes that volume flow rate as the hood inlet face area changes; which maintains a constant face area inlet velocity and operates unaffected by pressure changes and fluctuations which are inherent characteristics of the systems and air moving devices to which a hood is normally connected; and which maintains all of the above advantages even when multiple hoods are connected into a single exhaust system;

Saves energy, roughly estimated at 900 kilowatt hours of electric power savings per hood per cooling season, and at about 100 gallons of fuel oil per hood per heating season, by reducing the make-up air demand by the hood on heated and cooled air supply in the spaces in which located;

Saves installation costs, because the self-isolating performance characteristics provide an excellent engineering basis for connecting multiple hood units into one central exhaust system;

Reduces hazards such as extinguished burners, upset apparatus and blown away papers by providing uniform air velocity over the interior work surface for all positions of the face-opening sash;

Saves filters in the make-up air supply and in the exhaust system by eliminating the necessity for clean-filter over-design.

In brief summary given for purposes of cursive description only and not as limitation, the invention includes a system for providing constant intake velocity in fume-hoods and the like through hood exhaust throttleing responsively compensating for variations in access opening and ambient pressure.

The above and other objects and advantages of the invention will become more readily apparent on examination of the following description, including the drawings in which like reference numerals refer to like parts:

FIG. 1*a* is an isometric view showing typical fume-hood installation;

FIGS. 1*b* and 1*c* are isometric details diagramming the typical air-flow problem presented by conventional fume-hood installations; and FIG. 2 is a side elevational detail in partial section diagramming the fume hood of the present invention in representative embodiment.

GENERAL DESCRIPTION OF THE PROBLEM

FIG. 1*a* shows an ordinary hood 20 in the overall perspective of the complete air flow path of which it is an integral part, to point out the adverse influences which the external elements can cause in the operating performance of hoods not having benefit of this invention. These points are clarified as follows:

1. Make-up air supply 22: the replenishment volume rate of make-up air must equal the amount exhausted at 24 from the hood, and is often supplied under automatic room-static-pressure-control which varies the amount according to hood demand. This air is conditioned in winter and summer usually; the amount of energy required for this, and the filter consumption, are proportional to cumulative demand of the hood;

2. Laboratory or space 26 containing the hood; opening and closing of room doors affects the space static pressure and changes the volume flow rate through the hood erratically;

3. Laboratory Hood: volume flow rate through the hood 20 is dependent upon the pressure difference existing between the room static pressure and the pressure within the exhaust duct 28. This pressure difference also is constantly changing as doors are opened and closed and as make-up air filters 30 and effluent filters 31 become clogged.

4. Sliding sash 32: plane of the sash is the safety-important interface between the room and the interior of the hood where the air flow velocity must be adequate to capture and carry inward all gases, vapors, and particulate material. Typically, with the sash fully open air velocity may be barely adequate in conventional hoods, but excessive with the sash partly closed.

5. Exhaust duct 28: a manual damper 34 is provided in this duct for initial setting of the required volume flow rate. Changes in pressure difference across the damper change the flow rate.

6. Filters 30 and 31: design volume flow rate of the exhaust system for clean filters must exceed the minimum quantity that will produce a safe face-velocity through the hood when the flow through the filters is reduced to a minimum by dirt loading. This necessary over-design consumes more energy for conditioning make-up air and the excess demand shortens the life of the filters.

7. Air moving device 36: air moving devices deliver varying flow rates according to differences in pressure between inlet and outlet, (across the device). Thus, the delivery rate changes as room static pressure changes occur, filters become dirt laden, wind velocity and direction change at the stack outlet, etc.

FIGS. 1*b* and 1*c* diagram air flow aspects in conventional hood operation with sash open and sash closed, respectively.

Such hoods are designed to operate at a face velocity, or input air velocity across the plane of the sash, of 100 to 150 FPM (30 to 45 meters/minute) with sash fully open. As area of the opening is progressively decreased on sash closing, the air velocity through the diminishing opening progressively increases, the total amount of air exhausted tending to remain constant in response to constant exhaust-fan demand.

That according to the objects herein, the present invention simply solves the above problems and controls the volume flow rate through the hood independent of pressure differences, will be appreciated, and additionally because the invention employs in large part, readily available assemblies.

DESCRIPTION OF STRUCTURE OF THE INVENTION

FIG. 2 shows schematically the relation of the parts of the invention in a representative embodiment.

Conventional structure: the hood assembly 220 has conventional parts including exhaust duct 228 leading to a customary, nominally constant-demand exhaust fan (not shown), sliding sash 232 openable and closable in conventional guide structure 238, generally in the plane of the access opening 240 from top of housing 242 to base cabinet 244, which plane may be vertical. In the working space 246 beneath the exhaust and extending across the hood perpendicular to the sides and parallel with the back 248, the hood may have a conventional baffle 250 with appropriate slots 252 at heights assuring efficient purging of both light and heavy fumes and the like.

The co-acting inventive provisions of the invention comprise the means for producing through the access area a constant-velocity flow independent of ambient gas (air) pressure-changes and of variations in the access area, comprising:

(a) means for throttling throughput at the exhaust 228 in proportion to area of access opening 240, including: flexible links 254 attaching the sash 232 to first lever-arm 258 which is fixed to and extends from cam 260 and sets the orientation of the cam about pivot 262 in response to sash position; and, associated with the cam, cam follower 264 which in correspondence with cam orientation under cam following bias such as compression spring 265 sets the pivotal position of second lever arm 266, to which it is attached, about fulcrum 268 in the wall of the duct 228, thus setting the vertical position of the inner end of the first lever arm, which lies within duct, thereby establishing through a second flexible link 270 the axial position of sliding shaft or valve stem 272 in the sliding guide 274; this sets the axial position of valve gate 276 relative to the valve wall 278 in the exhaust duct; and (b) means for modifying the throttling of the throughput in proportion to variations in pressure of the ambient gas, including the hollow, truncated-cone-and-sphere shape of the valve gate 276 containing the compression-type spring return 280 biasing the valve gate 276 slidably on the valve stem 272 away from the stop 283 and from the venturi-taper throat 284 of the coacting wall section. This venturi portion is a commercially available assembly, and may, for example, be purchased as No. 101-VV valve from the MITCO VALVE COMPANY, 440 Somerville Avenue, Somerville, Mass., 02143, for applications which conventionally might require single exhaust ducts in the 5 inch to 12 inch diameter range. Sliding strut 282 is fixed to valve gate 276.

BRIEF SUMMARY OF OPERATION

Users of the hood are assured of constant velocity flow through the frontal area regardless of whether the sash is wide open or nearly closed, conserving energy and safeguarding experiments, equipment and papers from the usual effects of high velocity flow at partially open positions of the sash, by the following coactive provisions of operation.

As the sash closes or opens the cam rotates causing the cam follower to vary accordingly the axial position of the valve gate in the venturi throat, throttling the duct throughput air in amount continuously proportional to the area of the access opening. Surges or other pressure changes are automatically compensated by sliding movement of the valve gate on the valve stem.

Because the Mitco valve is a pressure independent valve, the self-contained feature of the spring-loaded cone or valve gate maintains the preset air flow automatically. Said another way, a rise in pressure increases the force against the cone, flexing the spring so that the cone moves along the fixed shaft deeper into the valve throat. This reduces the valve free area just enough to maintain the preset flow at the higher pressure. A decrease in pressure permits the spring to move the cone out of the valve throat. The annular free area increases just enough to maintain the original flow at the lower pressure.

The cone or valve gate thus serves to modify throttling of the throughput at the exhaust. It senses changes in throughput at the exhaust and compensates the changes in throughput sensed at the exhaust by sliding on the rod and varying the throughput-opening area at the venturi section of the duct. It will be noted that this compensation is by means independent of the throttling through setting of the linkage in predetermined relation to the area adjustment of the access opening by sash positioning.

The cam can be empirically contoured for any type installation. The front area of the hood changes as a linear function of sash opening. The flow relation of the venturi structure is more complex but easily measured in terms of exhaust duct throughput plotted against linear position of the valve gate with the gate clamped to the valve stem, rendering the pressure-compensating feature inoperative. It will be appreciated that other means can be used to achieve the same result, hydraulic, electric, mechanical, or whatever, singly or in combination.

DETAILED DISCUSSION OF OPERATION

In the old art generally, a fixed volume flow rate of air must be drawn through the face area, or plane of the sliding sash with that area at its maximum (sash wide open) in order to produce an in-flow velocity of air movement sufficient to insure capture and removal of fumes, vapors, and hazardous materials. The inter-relationship of these three variables is:

$$\text{Velocity} = \text{Volume flow rate/Area} \quad \text{(i)}$$

Thus, with a fixed volume flow rate, when the hood sash is placed at any lower position the face area or frontal area is decreased and the velocity through the opening is increased, while the volume flow rate remains essentially unchanged. The effects of several sash positions are shown in Table 1 below, for a typical hood having a maximum sash opening of 6.67 square feet and a face velocity of 150 feet per minute minimum:

Table 1

| Percent sash opening | Area of sash opening in square feet | Velocity in the sash plane, in feet per min. | Exhaust air, in CFM |
|---|---|---|---|
| 100 | 6.67 | 150 | 1000 |
| 75 | 5.00 | 200 | 1000 |
| 50 | 3.34 | 299 | 1000 |
| 25 | 1.67 | 598 | 1000 |

This table shows that no reduction in volume flow rate of exhaust air is achieved by lowering the hood sash, therefore during use of the hood and at all other times when the sash is raised, the hood is exhausting the full volume rate regardless of the actual amount of opening area. For each 1000 cubic feet per minute exhausted through the hood an equal 1000 cubic feet per minute must be brought into the laboratory to replace it. In winter the air must be filtered, heated, and humidified before it is allowed to enter the space in order to maintain habitation and special laboratory environmental conditions. The amount of fuel oil required to heat 1,000 cubic feet per minute is estimated as follows:

| | |
|---|---|
| Habitable space temperature | 72 deg. F. |
| Outdoor temperature | 32 deg. F. |
| Specific volume of the air | 13.7 cubic ft. per lb. |
| Specific heat of the air | 0.24 Btu per lb. per deg. F. |

$$\frac{1000 \text{ Cu. Ft./min.}}{13.7 \text{ Cu. Ft./lb.}} \quad 0.24 \text{ Btu/lb./deg. F.} \quad 72\text{F-}32 \text{ F-}700 \text{ Btu/min.}$$

700 Btu/min. = 42,000 Btu/hr.

Handbook sources give the heat value of fuel oil as an average of about 145,000 Btu per gallon. With a boiler efficiency of 75 percent and losses in steam transport, heat transfer and other natural losses the amount of available heat is reduced to approximately 87,000 Btu per gallon.

$$\frac{42{,}000 \text{ Btu/hr.}}{87{,}000 \text{ Btu/gal.}} = 0.48 \text{ Gallons per hour to heat 1000 CFM of make-up air}$$

About 3.8 gallons of fuel oil are needed to heat the make-up air supplied to the hood when it is operated for one shift of eight hours duration.

This invention automatically changes and further regulates the volume flow rate of air exhausted by making that rate proportionate to the sash height in a ratio which will result in a constant velocity of air in-flow in the plane of the sash at all sash positions. The volume flow rate for any sash position can be determined by rewriting the previously given equation with the velocity as a constant value:

$$\text{Volume flow rate} = (\text{Constant velocity}) \times (\text{Area of sash opening}) \quad \text{(ii)}$$

Now, unlike the ordinary hood shown before, when the sash is lowered the velocity through the face opening does not change, and the volume flow rate decreases proportionately as the sash is lowered. This effect is shown in Table 2 using the same example hood as before:

Table 2

| Percent sash opening | Area of sash opening, in square feet | Velocity in the sash plane, in feet per min. | Exhaust air, in CFM |
|---|---|---|---|
| 100 | 6.67 | 150 | 1000 |
| 75 | 5.00 | 150 | 750 |
| 50 | 3.34 | 150 | 501 |
| 25 | 1.67 | 150 | 250 |

This invention allows at least a 30% reduction in fuel oil use by operating the hood with the sash at the practical minimum height, or by limiting the sash with a releasable thumb latch to 30% less opening area. Under such conditions the improved hood would need only 2.7 gallons of fuel oil to heat the make-up air for one-shift of 8 hours duration.

The summer air-conditioning demand for treating the make-up air for the ordinary hood is estimated:

| | | |
|---|---|---|
| | Indoor conditions: | 75 deg. F. dry bulb, 50% rel humidity |
| | Outdoor conditions: | 95 deg. F. dry bulb, 78 deg. F. wet bulb |
| | Enthalpy of outdoor air: | 41.6 Btu per pound |
| | Enthalpy of indoor air: | 28.2 Btu per pound |
| | Specific volume: | 13.7 cubic feet per pound |
| (iii) | $\frac{1000 \text{ cu. ft./min.}}{13.7 \text{ cu. ft./lb.}}$ | (41.6 Btu/16.-28.2 Btu/lb.) = 978 Btu/min. |

Assuming an air conditioning heat removal rate at about 12 Btu per watt expended electric power, 39.1 kilowatt hours of electric power, 39.1 kilowatt hours of electric power will be required to treat the make-up air for the ordinary hood for one shift of 8 hours duration.

This invention, with the 30% reduction in the use of make-up air as described before, would require only 27.4 kilowatt hours of electric power for one shift of 8 hours duration.

In conclusion it is again emphasized that with minimum elements, all proven, in inventive combination, a new and substantial self-operating means for energy saving in running costs is achieved safely, at modest fixed initial cost with simplicity and reliability. In the preferred vertical exhaust embodiment described it can be seen that the valve is failsafe in that if the stem linkage should fail the valve would remain in the open position.

The invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. A method for producing constant-velocity flow of varying-pressure ambient gas through an access opening of a laboratory hood space having an exhaust for throughput and a closure for adjusting the area of the access opening, comprising the steps:

(a) throttling throughput at the exhaust in predetermined relation to said area adjustment of the access opening, and (b) modifying said throttling of throughput at the exhaust in proportion to said variations in pressure of the ambient gas, thereby producing said constant flow through the access opening of a laboratory hood space.

2. A method as recited in claim 1, wherein said modifying of the throttling of throughput at the exhaust includes the steps of:

(i) sensing changes in throughput at the exhaust, and (ii) compensating said changes in throughput sensed at the exhaust.

3. A method as recited in claim 2, wherein said sensing and compensating are through a sliding movement actuated independently of said throughput throttling.

* * * * *